United States Patent [19]

Schieser et al.

[11] 4,297,929

[45] Nov. 3, 1981

[54] SEPARATOR AND FEEDER FOR A STRIP OF FLEXIBLE BAGS

[75] Inventors: Warren J. Schieser, Dublin; Stanley E. Vickers, Hideaway Hills, both of Ohio

[73] Assignee: Liqui-Box Corporation, Worthington, Ohio

[21] Appl. No.: 105,567

[22] Filed: Dec. 20, 1979

[51] Int. Cl.[3] ..... B26D 7/00; B65B 3/00

[52] U.S. Cl. ..... 83/110; 83/112; 83/155; 83/436; 83/578; 53/300; 53/570; 493/224; 493/239; 493/288; 493/272

[58] Field of Search ..... 83/109, 112, 149, 155, 83/155.1, 436, 578, 110; 198/742; 53/300, 570; 493/224, 239, 288, 272; 271/198, 200, 271, 272, 273, 275, 202

[56] References Cited

U.S. PATENT DOCUMENTS

| | | | |
|---|---|---|---|
| 1,516,828 | 11/1924 | Rundell | 83/155 |
| 1,545,915 | 7/1925 | Maxson | 271/202 |
| 2,944,456 | 7/1960 | Christiansen | 83/155 |
| 3,309,952 | 3/1967 | Walsh | 83/578 |
| 3,435,943 | 4/1969 | Johnson | 198/742 |
| 3,446,103 | 5/1969 | Foster | 83/155 |
| 4,011,708 | 3/1977 | Brown | 53/570 |
| 4,120,134 | 10/1978 | Scholle . | |

*Primary Examiner*—James M. Meister
*Assistant Examiner*—K. Bradford Adolphson
*Attorney, Agent, or Firm*—William V. Miller

[57] ABSTRACT

Apparatus for receiving a strip of flexible bags with capped spouts at longitudinally spaced intervals which are to be separated at transverse joints and then fed individually to a point of use. It includes draw rolls for drawing the strip horizontally into cooperation with a separator, means for vertically reciprocating the separator to pass through the strip and separate the leading bag therefrom, a guide channel for receiving the spout of each separated bag, and a feeding element for engaging the spout on each successive bag and arranging the spouts in predetermined spaced relationship relative to previously inserted spouts and with the leading bag in a selected position for its spout to be engaged by bag-withdrawing means.

28 Claims, 19 Drawing Figures

212
242
125
LV3
MA
201
208
A-3-4
210
170
FF
216
A-2
211
C-4
N
205
202
175
LV4
262
266
B-3
204
D-1
PULSE
AV2
D-3
213
C-2-3
B-1
263
LV5
AV5
D-2
260
261
SW2
MA2
AV4
LV6
80
206
265
K-3
79
209
SW1
+V
240
D
AV1
H-4
SR
MEM
110
B
251
L-3
221
J-3
AV3
105
231
L-4
220
223
G-1
D-1-2
233
241
LV7
253
230
255
LV8
256
224
254
255a
G-5
J-4
226
G-2
254a
253a
256a
G-6
225
G-4

SEPARATOR AND FEEDER FOR A STRIP OF FLEXIBLE BAGS

BACKGROUND OF THE INVENTION AND PRIOR ART

It is common to supply strips of bags made of flexible plastic with capped spouts at longitudinally spaced intervals and with transverse seams or perforations where individual bags are to be separated from the strip for use, such as on a filling machine. For example, such bags are separated from a strip and presented to a filling machine of the continuous rotary type disclosed in copending application Ser. No. 105,664, filed Dec. 20, 1979 U.S. Pat. No. 4,120,134 discloses a machine which includes means for feeding a strip of bags and separating individual bags therefrom, but, in this machine, the leading bag of the strip is separated from the others only after it is filled, since the filled bag is relied upon to pull the strip through the machine. On the other hand, the present invention provides for moving the strip into the separator, separating individual bags therefrom and guiding and presenting the separated bags to the filling machines.

BRIEF DESCRIPTION OF THE INVENTION

The present invention comprises in-feed conveyor means for gripping the leading end of the flexible strip of capped spouted containers and feeding it horizontally into association with draw rolls which are so formed as not to displace or distort the strip laterally. The draw rolls bring the strip into cooperation with a vertically reciprocable separator which passes through the strip in its vertical reciprocation to separate the leading bag from the strip. The strip is moved precisely into position relative to the separator so that separation will occur accurately at each successive transverse seam or perforation. The separator itself also is so formed that it will not distort or displace the strip laterally. Guiding and feeding means is provided beyond the separator and includes a guide channel for receiving the spouts of the successively separated bags and in which they are arranged in predetermined longitudinally spaced relationship by a rockable and longitudinally reciprocable carriage which carries a series of spout-engaging and moving fingers. At the outlet end of the guide channel, escapement means is provided for holding the spout of the leading bag until it is engaged by the filling machine or is otherwise withdrawn for use.

BRIEF DESCRIPTION OF THE DRAWINGS

The best mode contemplated in carrying out this invention is illustrated in the accompanying drawings in which.

BRIEF DESCRIPTION OF THE INVENTION

Figure 1:
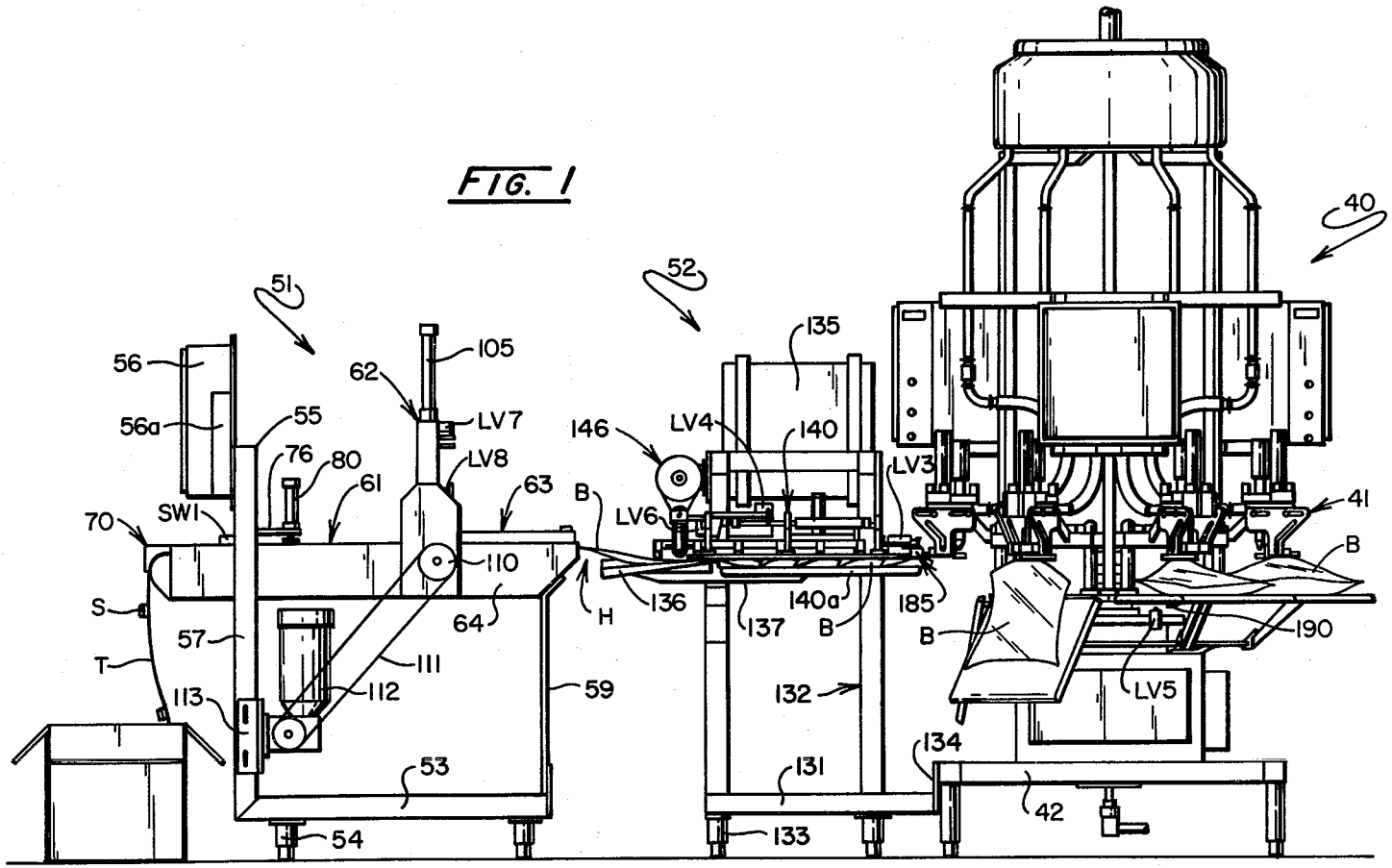
FIG. 1 is a side elevational view of the separator and feeder machine of this invention and showing schematically a filling machine with which it may be used.
Figure 2:
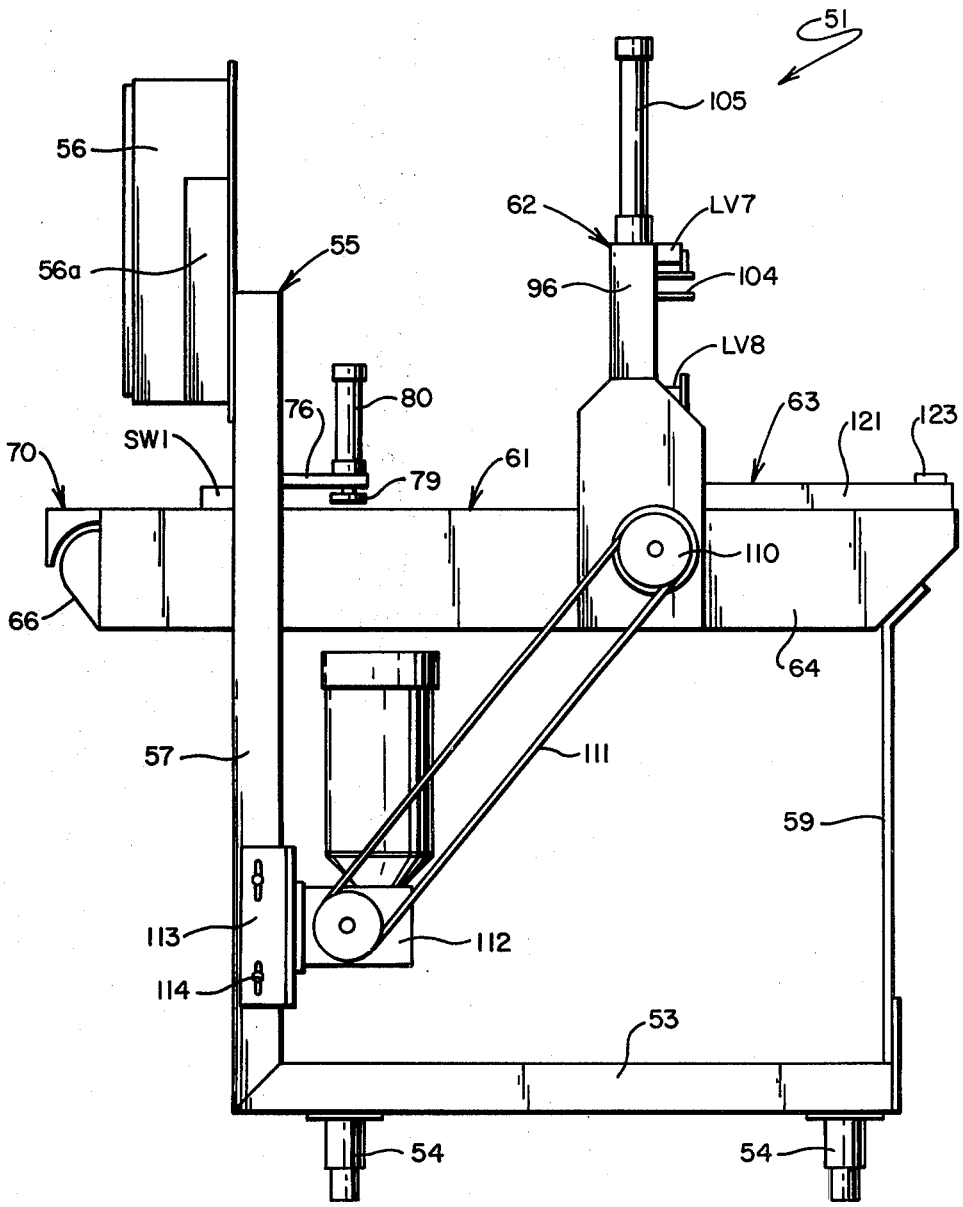
FIG. 2 is a side elevational view of the separator unit of the machine.
Figure 3:
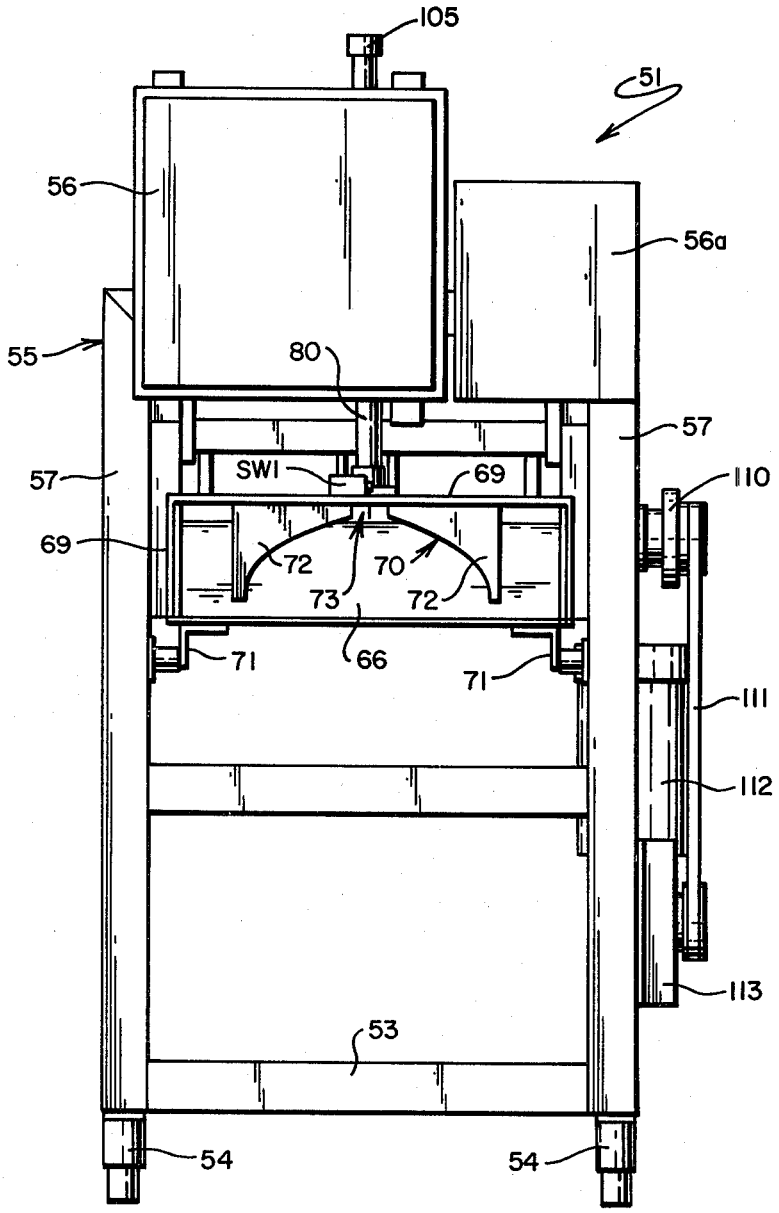
FIG. 3 is an elevational view of the front or loading end of the separator unit.
Figure 4:
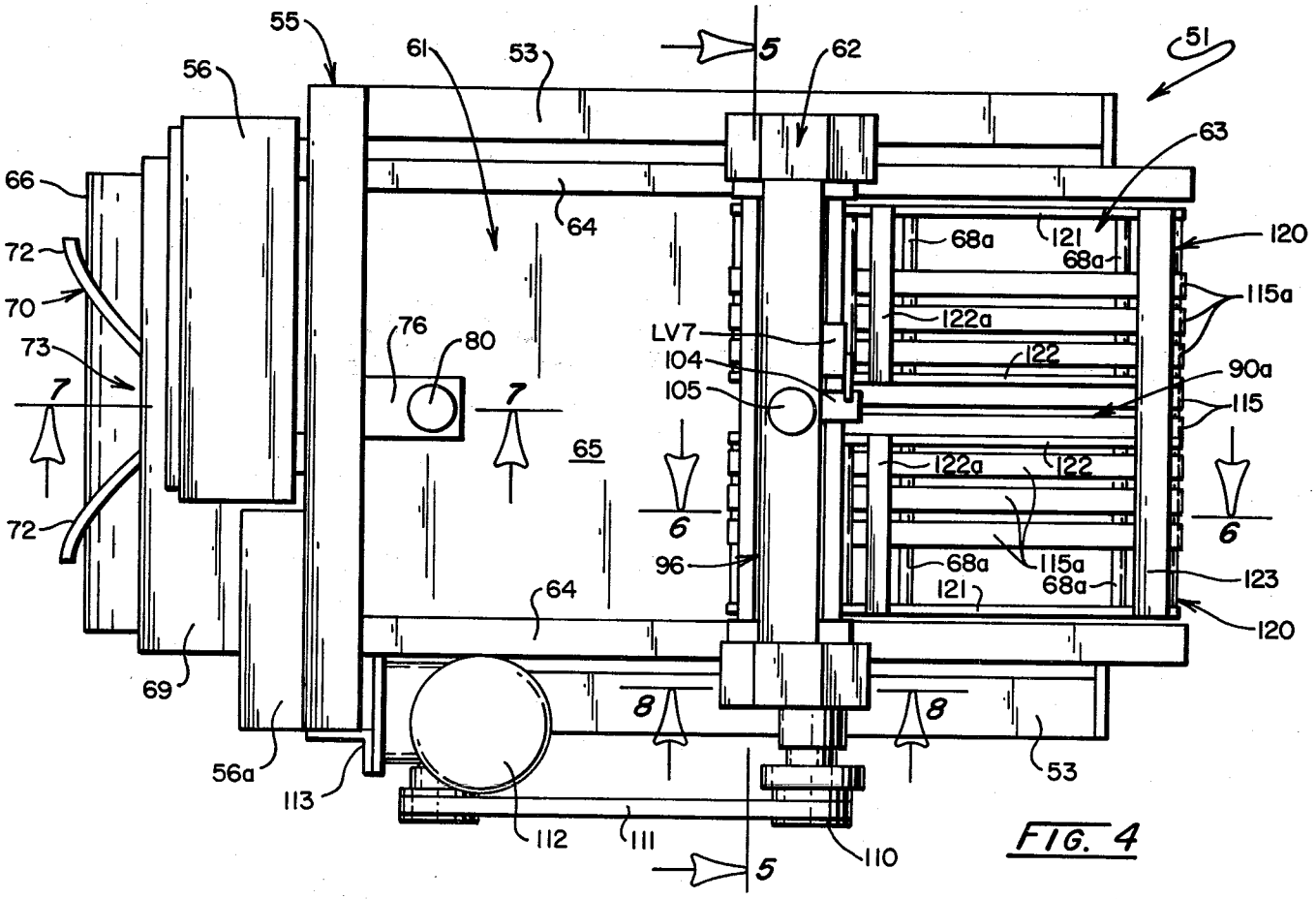
FIG. 4 is a plan view of the separator unit.

This invention will be described with reference to a strip T (FIG. 1) of flexible plastic bags B which is folded at transverse perforated lines or seams P (FIG. 7) and packed in a carton as indicated in FIG. 1. The strip is to be separated at the longitudinally spaced lines or seams P to form the individual bags. In the example shown, spout S will be mounted in longitudinally spaced upstanding positions on the strip T along its centerline and when the strip is separated into individual bags, each bag will have one of these spouts adjacent its upper end. This spout will have a friction cap C thereon (FIGS. 5 to 7) which is applied by axial downward pressure and is removed by axial upward pressure. Each spout may be provided with one or a plurality of axially spaced peripheral flanges F to facilitate holding during cap removal and replacement and each cap may be provided with at least one peripheral flange or rib R to facilitate application to or removal from the spout. These ribs and flanges are also useful to handle the bag strip and separated bags.

Although the following description will refer specifically to the strip of spouted and capped bags described above, it should be understood that certain features of the invention are not limited thereto.

For illustration purposes only, the automatic separator and bag feeder of this invention is shown separating and feeding bags B to a filler machine 40 of the continuously rotating turret type. Such a machine is illustrated in the copending application previously mentioned. However, it is to be understood that the separator and feeder of this invention is capable of other uses.

The separator unit is indicated generally in FIG. 1 by the numeral 51 and the feeder unit is indicated generally by the numeral 52 and are shown as separately mounted units but they could be mounted on the same framework. The unit 51 is disposed outermost and the unit 52 is disposed between unit 51 and the filler 40 with which it may be used. The units 51 and 52 are disposed with their centerlines in alignment and extending radially from the filler 40.

The automatic bag separator unit 51 is shown in detail in FIGS. 2 to 8 as well as generally in FIG. 1. It consists of a horizontal base 53 supported by the vertically adjustable legs 54. The base carries at its front or outer side an upstanding frame 55 which has boxes 56 and 56*a* mounted on its upper end that are adapted to hold the control system for this automatic bag feeder. The frame includes the upstanding laterally-spaced posts 57 (FIG. 7) having a transverse beam 58 towards the upper end thereof.

At a suitable level, the base carries by means of the frame 55 and inner legs 59, a supporting structure for the bag-in-feeder 61, the bag separator 62, which is disposed transversely and is vertically reciprocable and receives the leading end of the bag strip T for separation, and the discharge conveyor 63 for discharging the separated bags to the feeder unit 52.

Figure 6:
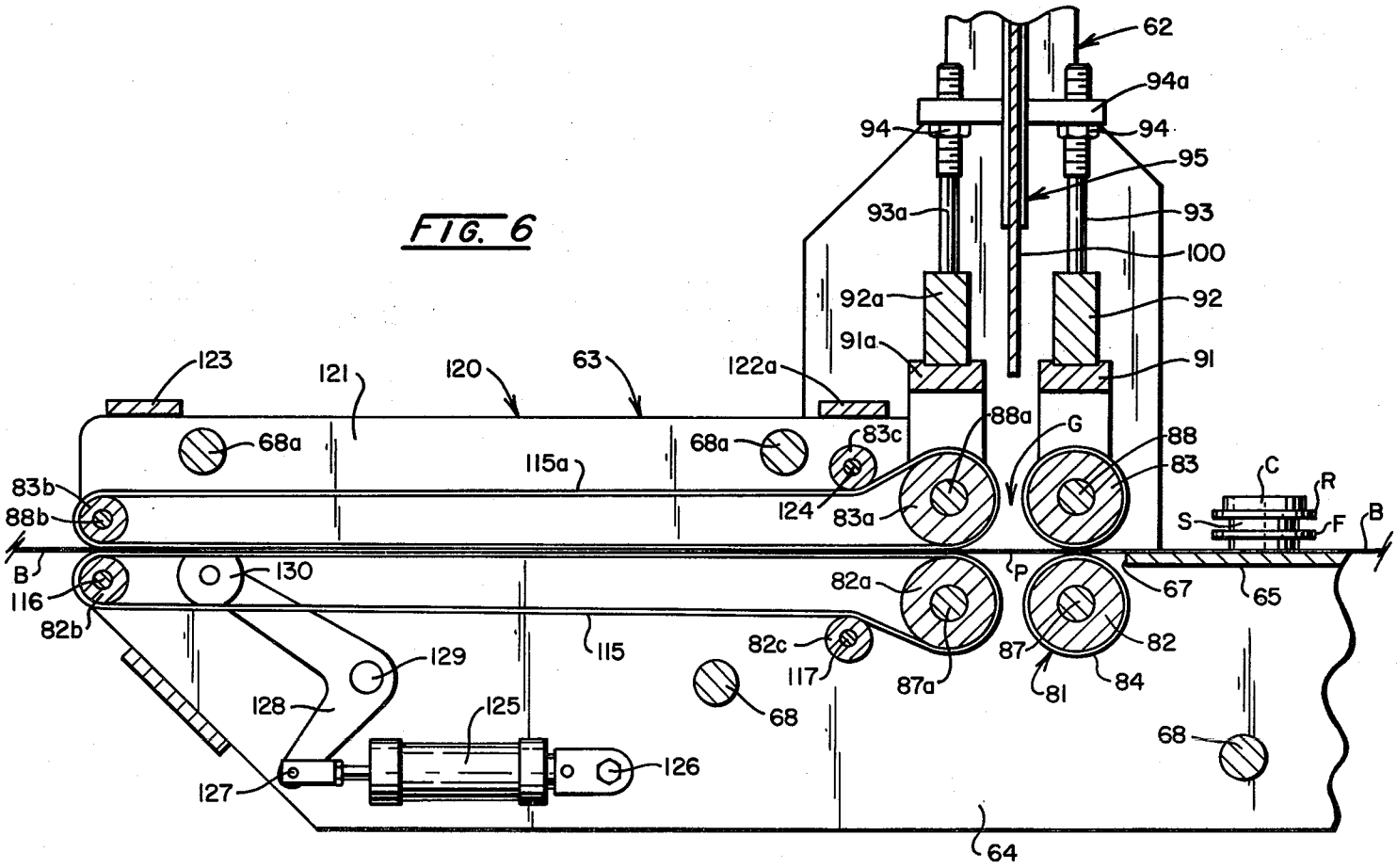
FIG. 6 is an enlarged longitudinal vertical sectional view taken along line 6—6 of FIG. 4.

The bag in-feeder 61 includes the bag support bed plate 65 which is supported in horizontal position by the longitudinally-extending parallel side support plates 64 and which extends from a point adjacent the inlet end of the unit 51 to a point just short of the separator 62 (FIG. 6). At the inlet end of the in-feeder 61, the plate 65 is curved downwardly at 66 and its opposite or inner end is provided with a substantially straight edge 67. The plates 64 extend the full length of the unit 51 and are held in proper spaced upright positions by the transverse rods 68 and the plates are suitable attached to the posts 57 of the frame 55 and to the upper ends of the legs 59.

Supported above the curved forwarded end 66 of the bag support plate 65 is a bag and spout guide 70. This guide 70 depends from an inverted U-shaped support 69 (FIGS. 3, 4 and 7) which is supported by angle brackets 71, that also support the curved plate end 66, and which are attached to the posts 57. The guide 70 consists of a pair of guide flanges 72 which are in diverging relationship at their outer ends to form a wide mouth and which gradually converge at their inner ends to form a spout-engaging guide throat 73. It will be noted that the lower edges of the flanges 72 are curved to fit the contour of the downwardly curved end 66 of the bag support plate 65. Consequently, as the strip T is drawn upwardly into the in-feeder 61 to move along plate 65, the spouts S thereof will be engaged at the guide throat 73 to center the strip so that its centerline corresponds to that of the plate 65.

Supported by the support 69 just beyond the guide throat 73 and above the plate 65, is a switch SW1 (FIG. 7) which has a depending actuating trigger 75 that will be engaged by each successive capped spout S and the strip T.

Carried by the cross member 58 supported by the posts 57 of the frame 55, is a rearwardly-extending horizontal support arm 76 which is above and parallel to the bag support plate 65. The arm 76 has supported on its rear end an upstanding cylinder and piston unit 80. This unit has on the lower end of its depending piston rod a removable and replaceable shoe 79 which is adapted to press down on each cap C as it is positioned beneath the shoe by the intermittently moved bag strip T. This ensures that the cap C is always pressed down to its lowermost position on the spout S. The shoe can be removed and replaced for different type caps. It will be understood that the unit 80 is located in alignment with the spout guide throat 73.

The bag in-feeder 61 also includes a set of draw rolls 81 (FIGS. 5 and 6) which draw the strip along the plate 65. This set includes a single transversely extending lower roller 82 and a pair of transversely-extending, laterally-spaced upper rollers 83. Each of the rollers has alternating pressure gripping bands 84 and grooves or recesses 85. It will be obvious that the bands 84 of rollers 83 align with and engage with the bands 84 of roller 82. The roller 82 extends transversely between the side supports 64*a* and is carried by a driven shaft 87 journalled therein by bearings 86. The supports 64*a* are in the form of plates fastened in flat contact to the outer surfaces of plates 64 towards the inner ends thereof and upstanding therefrom. The roller 82 is supported at such a level that the upper surface (FIG. 6) of the bands 84 thereof will be at the same level as the bed plate 65. The rollers 83 are carried by the respective shafts 88 in such a manner that they are axially spaced laterally (FIG. 5) to provide a space 90 therebetween through which the successive upstanding spouts S can pass and which is at the centerline of the feeder unit. The shafts 88 are carried in bearings on the depending portions of inverted U-shaped supports 91 which are supported by a transverse beam 92 which extends between and is supported by the vertical extensions 64*a* carried by the respective plates 64.

It will be noted (FIG. 5) that the outermost strip-engaging bands 84 on the respective rollers 82 and 83 are located substantially laterally within the edge E of the strip T to be gripped by the opposing rollers 82 and 83. This is important because the strip usually has heat-sealed seams at its edges which are of different and non-uniform thickness, as compared to that of the strip inwardly thereof, and if gripped at the edges by the rollers, the strip would tend to be displaced or distorted laterally as it is pulled through the rollers. Also, by having band-contact by the bands 84 at laterally spaced narrow widths across the strip, instead of continuous contact, shallow longitudinally extending temporary grooves are formed in the upper and lower surfaces of the strip which aid in preventing distortion or displacement.

In order to accurately position the rolls 83 at the proper level relative to the roll 82 to obtain the desired gripping pressure on the strip T, the supports 91 are vertically adjustable (FIG. 6). For this purpose they are suspended from the crossbeam 92 by the screws 93 which are locked in place by nuts 94 on support bracket 94*a*. Similar U-shaped supports 91*a* are suspended from a crossbeam 92*a* by screws 93*a* from the beam 94*a* just beyond and parallel to the members 91 for supporting the shafts 88*a* of the discharge conveyor 63. The shaft 87*a* thereof is supported below shaft 88*a* and parallel to shaft 87. These parts of the conveyor 63 will be referred to later but it will be noted that the shafts 87*a* and 88*a* support rolls 82*a* and 83*a* of a second set in longitudinally spaced relationship to rolls 82 and 83 of the first set to provide a transverse, vertical gap G in which the separator 95 of the unit 62 can reciprocate.

The bag separator unit 62 comprises a yoke or inverted U-shaped frame 96 which is disposed transversely with its centerline in the same transverse plane as the gap G. The bag separator 95 is mounted for vertical reciprocating movement on the upright frame 96. The lower ends (FIG. 5) of the vertically disposed sides of the frame 96 are fixed to upstanding side plate extensions 64*a*. It will be noted that the side members of frame 96 are in the form of inturned channels and carry inwardly-extending notched guide brackets 97 at vertically spaced intervals for guiding vertical movement of the separator 95. This separator 95 includes parallel vertical rod guide portions 98 which slide in guide brackets 97 and which carry severing plate 100 on their lower ends. Plate 100 has a pair of triangular upstanding severing triangles 100*a* and 100*b* at its upper edge and a pair of similar depending triangles 100*a* and 100*b* at its lower edge. These severing triangular portions 100*a* and 100*b* engage the bag strip to separate the adjacent bags at the successive heat-sealed seams P, which may be perforated, both on the downward and upward travel of the separator member 95. The separator 95 is supported for vertical reciprocation by means of a crosshead 101 which is a part thereof, and from which rods 98 are suspended, and is carried by the lower end of the piston rod of a cylinder and piston unit 105 that is supported by the top member of the yoke frame 96.

During downward movement of the separator 95, the triangular lower portions 100*a* and 100*b* of its blade 100 will pass downwardly through the bag strip T at the joint P to separate a bag therefrom, engaging the bag strip at two points intermediate its side edges and then gradually inwardly and outwardly from these points in both direction. Before upward movement of the separator 95, the bag strip T will have been advanced through it between rods 98, so the triangular upper portions 100*a* and 100*b* of the separator blade 100 will subsequently pass upwardly through it to separate a bag therefrom, engaging it first at its side edges and then gradually inwardly therefrom to its centerline. Thus, during both the upward and downward strokes of blade 100, the strip is contacted by the triangular points of portions 100*a* and 100*b* in areas spaced from the edges of the strip which is at that time supported by the draw rolls 82 and 83 and 82*a* and 83*a*. This prevents lateral displacement and distortion of the bag strip.

Figure 5:
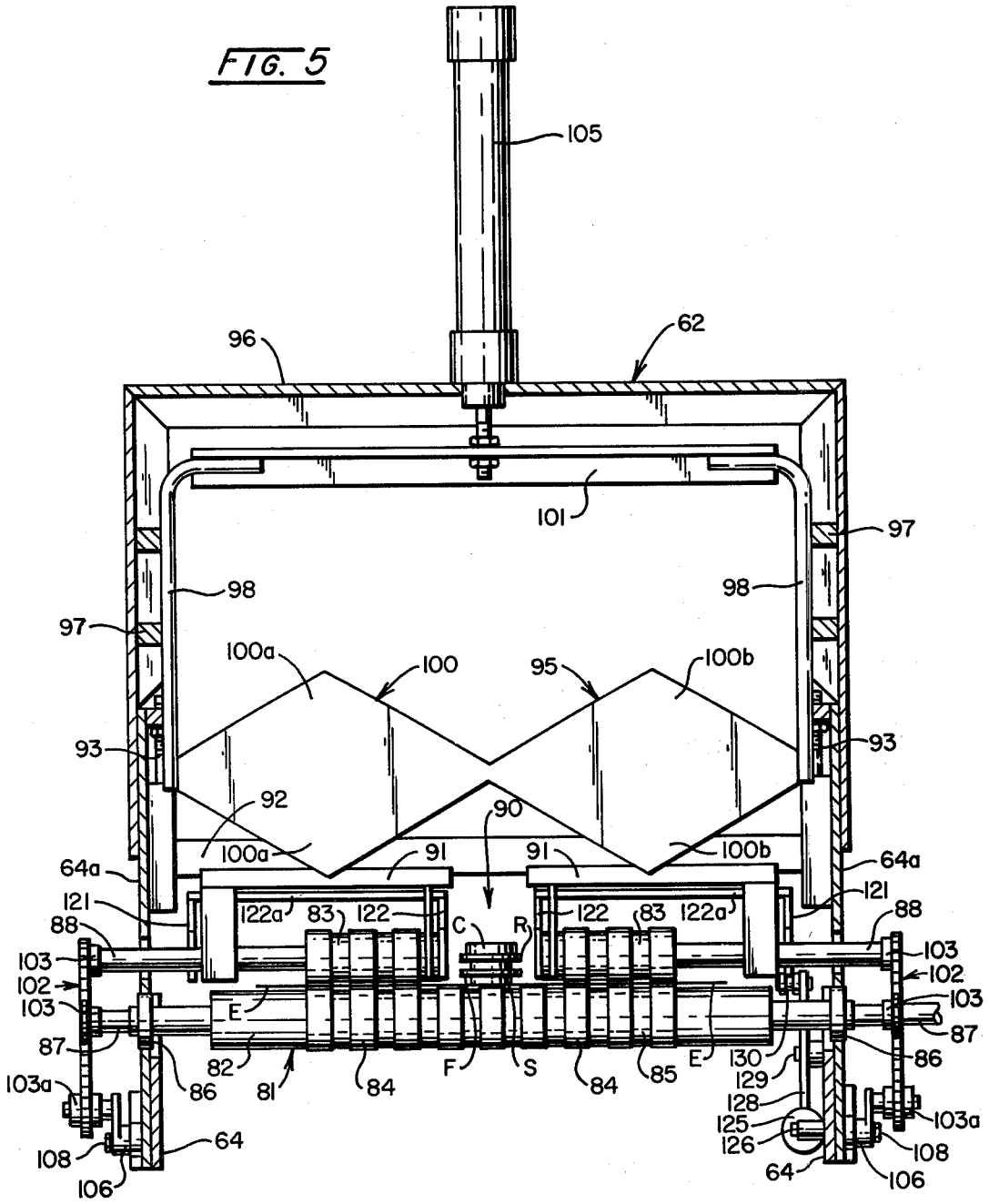
FIG. 5 is an enlarged transverse vertical sectional view taken along lone 5—5 of FIG. 4.

As previously indicated, the roll 82 is carried by shaft 87, the roll 83 by shaft 88, the roll 82*a* by shaft 87*a* and the roll 83*a* by shaft 88*a*. All of these shafts have their opposed outer ends projecting outwardly beyond the plates 64 and extensions 64*a* attached thereto (FIG. 5). All of these shafts are connected together for simultaneous rotation by a chain drive 102 (FIGS. 5 and 8) at each side which includes pinions 103 on the corresponding ends of the shafts. The tension on the chain is adjustable by means of a pair of lower pinions 103*a* carried by brackets 106, pivoted at 107 to the plate extension 64*a*, and clamped in place by means of a clamping bolt 108 cooperating with an arcuate slot 109 in the bracket. The one end of shaft 88 is extended and cooperating therewith is a standard pneumatically-actuated brake and clutch 110 (FIGS. 2 to 4) to provide an intermittent drive for this shaft. This unit 110 is driven by a timing belt or chain 111 from a gear-reduction and electric motor 112. This unit 112 is mounted on one of the posts 57 for vertical adjustment to vary the tension on belt 111 by means of a bracket 113 and bolt and slot connection 114. Thus, with this drive all of the rolls 82, 83, 82*a* and 83*a* will be driven simultaneously at controlled intervals to draw the strip along the plate 65 to successively position the transverse joints P thereof in the gap G directly below the separator 95 (FIG. 6).

The discharge conveyor 63 includes the intermittently drive roll 82*a* and 83*a* referred to previously and a cooperating third set of rolls 82*b* and 83*b* located substantially beyond these rolls (FIG. 6) which carry positively-driven movable bag-strip gripping and supporting means in the form of continuous bag-strip engaging and moving or feeding lower bands 115 and upper bands 115*a*. These bands are arranged in pairs of laterally-spaced, longitudinally-extending upper and lower bands so that the strip will be engaged at laterally spaced intervals corresponding to its engagement by the rolls 82 and 83. Thus, this will tend to continue the shallow grooves of engagement of the bag strip and prevent lateral distortion or displacement thereof.

The lower bands 115 are supported by the outer roll 82*b*, as indicated, which is carried by a shaft 116. Adjacent the roll 82*a*, a belt tensioning roll 82*c* is carried by a shaft 117. The shafts 116 and 117 extend transversely between the plates 64 and are journalled in bearings therein. These lower bands thus support the lower surface of the bag strip T.

The upper surface of the bag strip T is engaged by the upper bands 115*a* and these upper bands are divided into two groups which are laterally spaced (FIG. 4) to provide a longitudinally-extending space or channel 90*a* through which the upstanding bag spouts S can pass. Each group of upper bands 115*a* is carried by a sub-frame 120 mounted for vertical swinging movement about the roll shaft 88*a*. This sub-frame consists of the outer side beams 121 and inner side beams 122 and the transverse support rods 68*a* and inner transverse support bar 122*a*. A transverse outer bar 123 extends across the top edges of the side beams 121 of both frames 120 and is secured thereto so that both frames 120 will swing vertically at the same time. Each roll 83*b* is carried by a transverse shaft 88*b* journalled on the side beams 121 of the respective frame 120. A tensioning roll 83*c* is carried adjacent roll 83*a* by transverse shaft 124 also journalled in beams 121.

The means for swinging the frames 120 vertically simultaneously comprises a cylinder and piston unit 125 (FIG. 6) which is pivoted for vertical swinging to one of the support plates 64 at its inner side as indicated at 126. The piston rod of this unit is pivoted at 127 to a crank arm 128 which, in turn, is pivoted at 129 to the plate 64 for vertical swinging movement. The other end of the crank arm carries a roller 30 which engages the lower edge of one of the side beams 121 of a sub-frame 120. Thus, when unit 125 is actuated at timed intervals, the bag B, severed by the separator 62, will be released. When in lowered position, the belts 115*a*, carried by frames 120, will cooperate with the lower belts 115 to grip and move the severed bag towards the unit 52.

From the separator unit 51, the separated bag B is fed into the cooperating feeder unit 52, as indicated in FIG. 1. This unit 52 is shown in detail in FIGS. 9 to 19, inclusive. This feeder 52 is adapted to receive the individual bags B which will be successively pushed from the unit 51 by the cooperating bands 115*a* and 115 and released by upward movement of the frames 120, after the leading edge thereof has been engaged by the unit 51. The engagement of the rear end of the discharging bag B by the discharge conveyor 63 has a slight corrugating effect which keeps its forward unsupported end relatively stiff so it will feed over the gap H (FIG. 1) between the units 51 and 52, which is kept narrow by positioning unit 51 close to unit 52, which is shown in cooperative relationship with filler 40.

This guide and feeder unit 52 comprises a frame which consists of base 131 and an upstanding side portion or standard 132. The base 131 is supported on vertically adjustable depending legs 133 and at its inner or rear side has a bumper 134 which is adapted to engage with the base frame 42 of the rotary turret filler (FIG. 1). At the top of the standard 132, a box 135 for enclosing the controls of the bag feeder unit 52 may be provided.

At the front or outer side of the standard 132, bag rest and guide 136 is supported which will receive each bag B as it is discharged from separator unit 51. This bag rest (FIG. 18) comprises left and right sections 136*a* and 136*b* which are supported by a longitudinally-extending box beam 137 (FIGS. 9 and 10) carried by a bracket 138 extending laterally inwardly from one of the posts 132*a* of the standard 132 rod adjustable vertically thereon by means of a bolt and slot mounting 139. It will be noted that the outer end and side of each section 136*a* and 136*b* is turned downwardly at 136*c* to facilitate movement of the separated and discharged bag B into the unit 52. Guide 136 will direct the bag into a feeder 140 which will guide, space and feed the successive bags fed to it.

The feeder 140 is supported in a preselected horizontal position from the standard 132 by laterally-inwardly extending brackets 142*a*. These brackets have fixed at their opposite sides a longitudinally-extending upright support plate 142. Fixed to the plate 142 are the two inwardly-extending end support yokes 141 which are of substantially inverted U-form. The yokes 141 are spaced longitudinally of plate 142 and support a pair of guide strips 143 extending longitudinally therebetween which are disposed in laterally-spaced relationship to receive the upstanding bag spouts S in the channel 144 (FIG. 12) formed therebetween. A third middle support yoke 141*a* may be provided and secured to plate 142. The forward ends of the strips 143 are beveled to form a flared throat 145 for the entrance of the successive spouts S on the bags B from the support and guide 136. The inner edges of the strips 143 are of reduced thickness at 143*a* (FIG. 14) to facilitate entrance into the groove on each spout S between the vertically spaced ribs R thereon.

Figure 9:
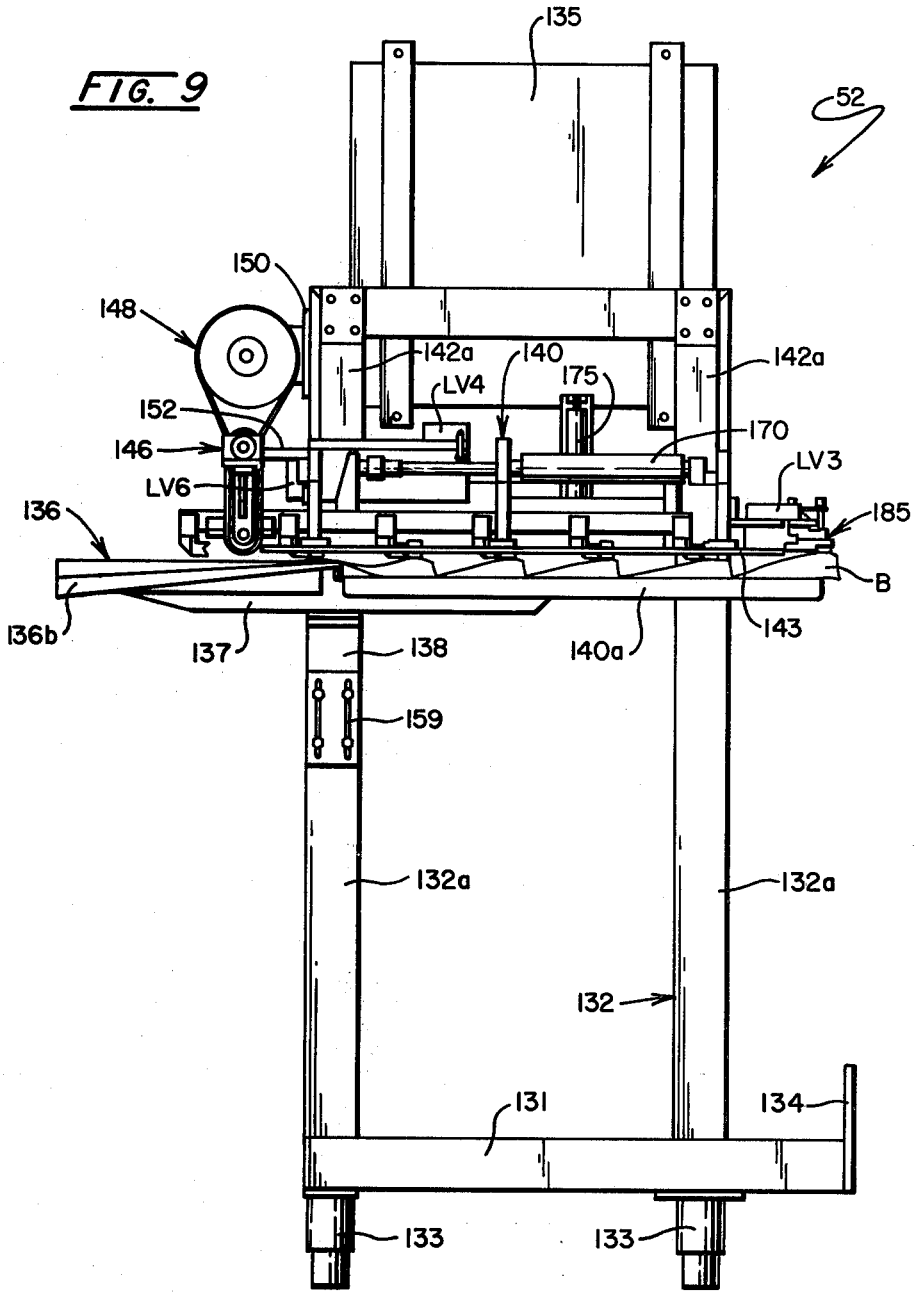
FIG. 9 is a side elevational view of the feeder and guide unit of the machine.
Figure 10:
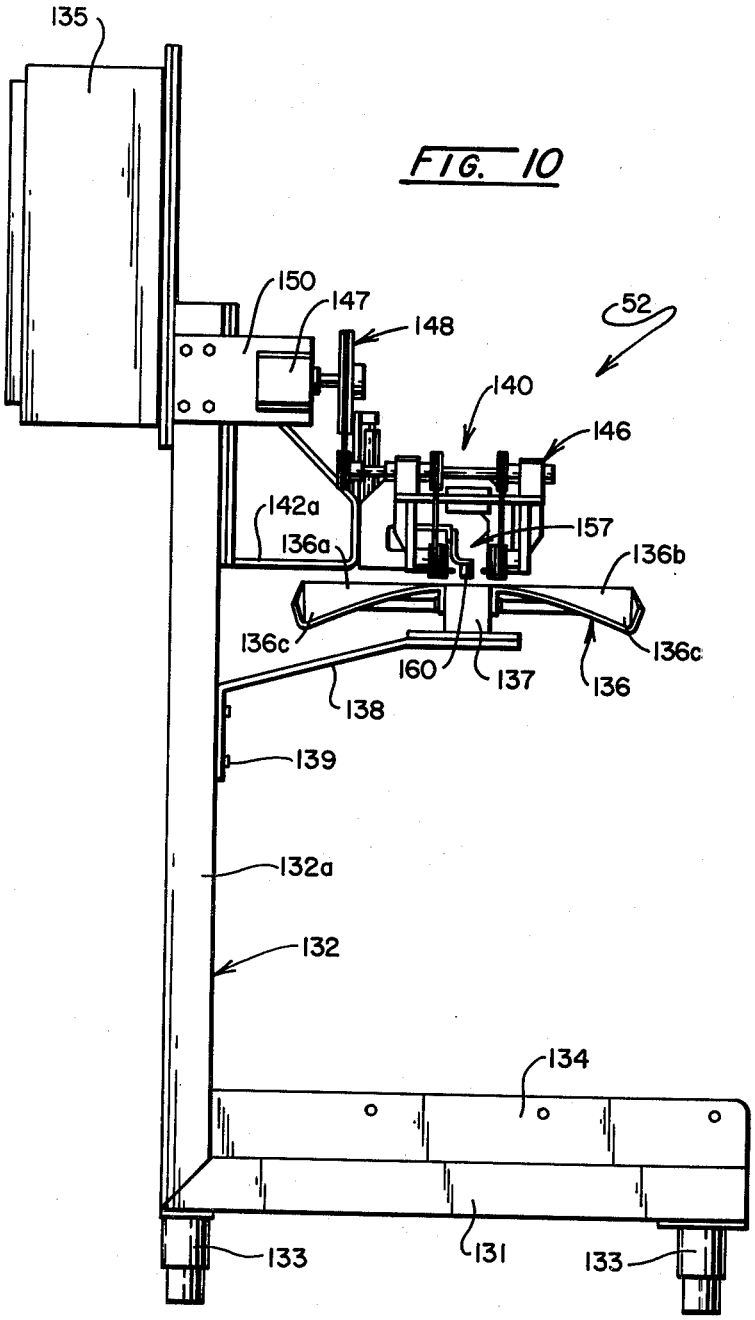
FIG. 10 is an elevational view of the outer or loading end of the feeder unit.
Figure 18:
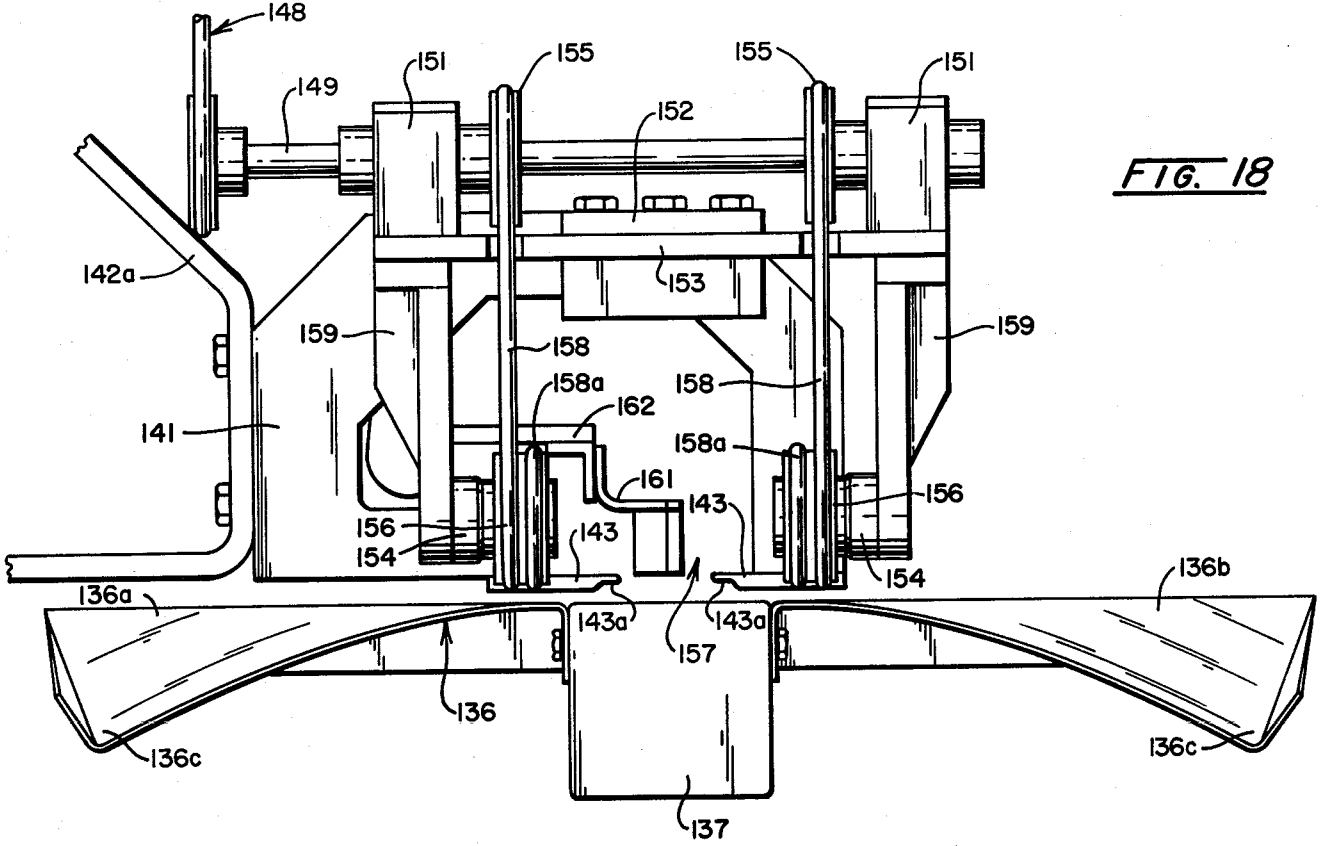
FIG. 18 is an enlarged end view of the inlet end of the feeder unit.

For aiding the guide 136 in directing the separated bags B successively into the feeder 140, with the spout S entering the mouth 145 of the guide channel 144 thereof, a live guide arrangement 146 is provided above the guide 136 (FIGS. 9, 10, and 18). This live guide 146 includes a drive motor 147, carried by a bracket 150 attached to the upper end of post 132*a*, and driving a belt drive 148. This belt drive rotates a transverse shaft 149 which is supported horizontally in bearings 151, carried by a horizontal plate 153 on the outer end of a bracket 152, extending horizontally outwardly from the adjacent yoke 141. Between the bearings 151, the shaft 149 carries the drive pulleys 155 which are axially spaced thereon, and which drive correspondingly spaced pulleys 156 disposed at a lower level. However, each of the pulleys 156 is supported by a stub shaft 154 so that there is a spout passage space 157 (FIG. 18) therebetween. Each pulley 155 has a belt or band 158 passing around it and a cooperating lower pulley 156. The pulleys 156 are supported at such a level that the lowermost bag contacting surfaces thereof are at substantially the same level as the spout guide strips 143. Each driven pulley 156 may also have an annular rib 158*a* for engaging the upper surface of the bag B. The pulleys 156 are supported at the proper levels by means of laterally-spaced support arms 159 depending from the horizontal support plate 153. The bag-engaging bands 158 and engaging ribs 158*a* will engage the bag B substantially outwardly of the spout but inwardly within its outer edges. In many cases, the separated bag B will not be engaged by the live guide 146 but only if its edges tend to curl up as it passes into and over the guide 136, at which time, it will be engaged and pushed downwardly onto guide 136 and into throat 145.

The guide 136 joins at its inner end with the end of a flat bed plate 140*a* which extends the full length of the feeder 140. This plate serves as a support along which the separated bags B are fed and on which they are spaced in shingled relationship as indicated in FIG. 9. The plate 140*a* is supported by an extension of the beam 137.

Figure 12:
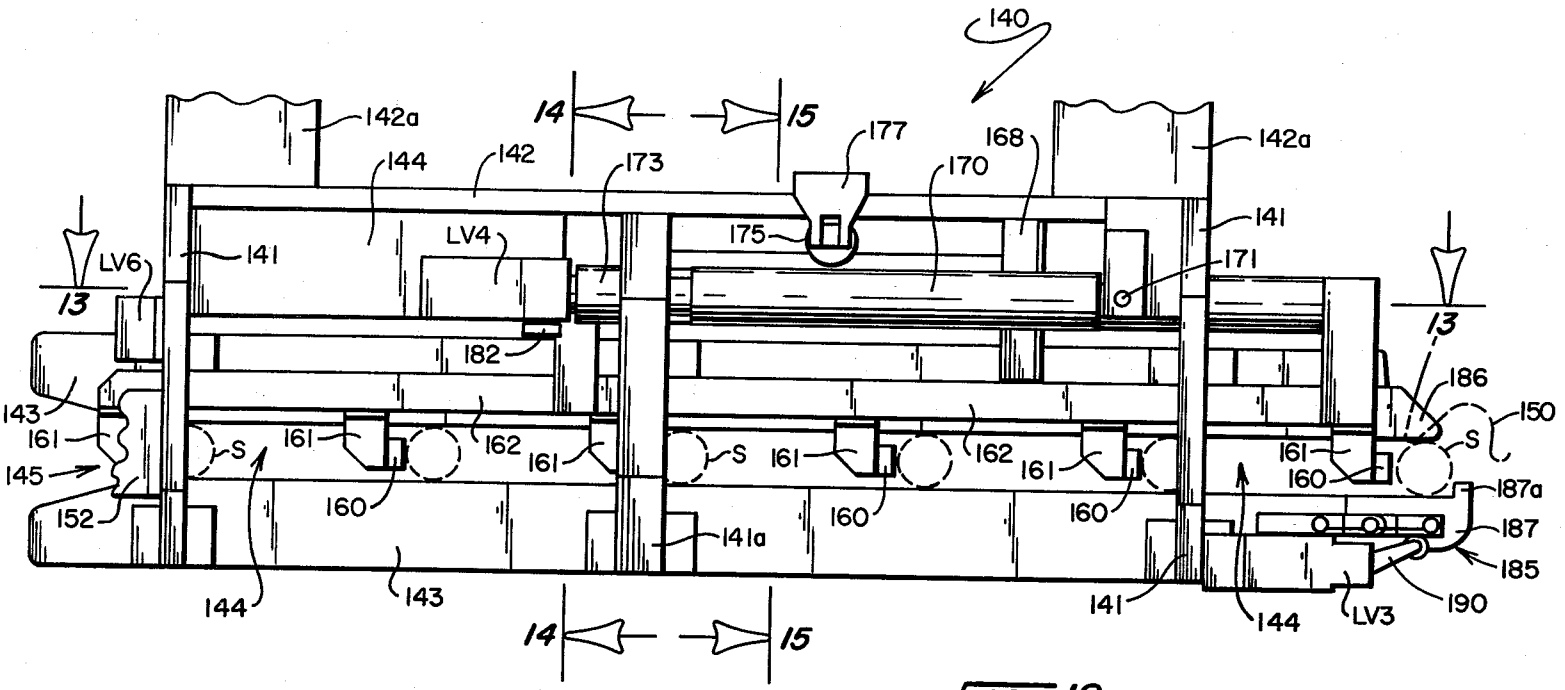
FIG. 12 is an enlarged plan view of reciprocable spout-engaging carriage and associated parts.
Figure 13:
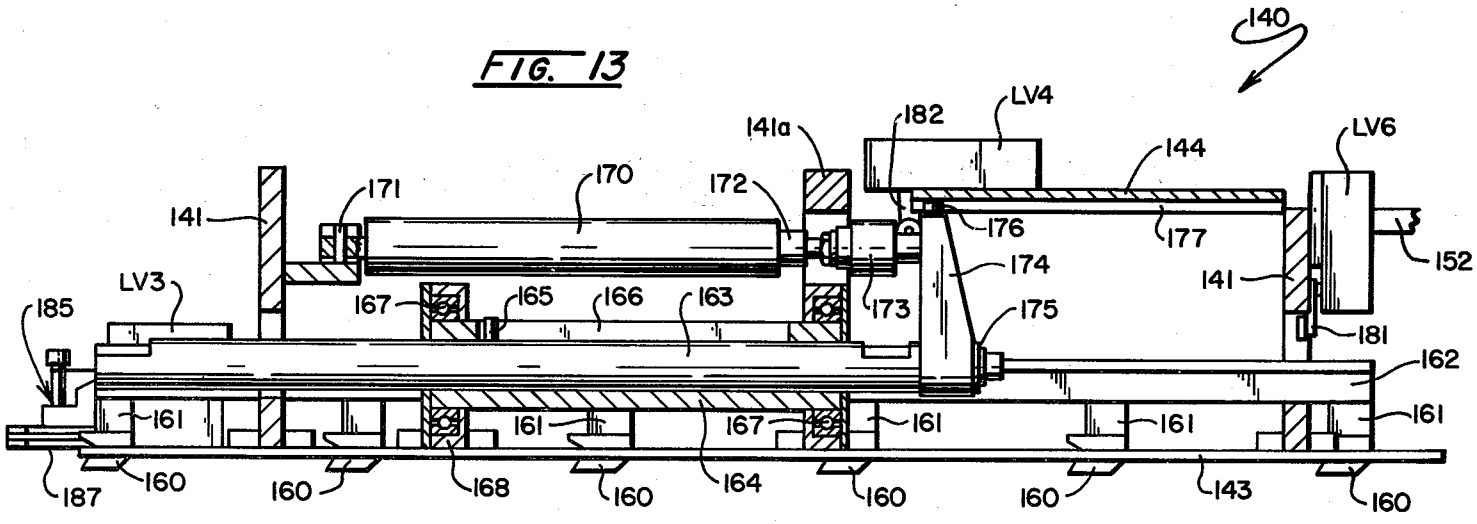
FIG. 13 is a longitudinal vertical sectional view taken along line 13—13 of FIG. 12.

After each spout S is inserted in the guide channel 144, it is engaged by a moving finger 160 for moving it in the channel and spacing it in a predetermined spaced relationship relative to previously inserted spouts (FIG. 12). A plurality of these fingers 160 depend from brackets 161 which are supported at longitudinally spaced intervals by and extend downwardly and outwardly from a transversely rockable and longitudinally slidable carriage 162. This carriage is supported for rocking and longitudinal movement by a longitudinally-extending parallel rod 163 which is mounted for axial movement in a bearing sleeve 164 (FIG. 13), the rod having a radial stop pin 165 cooperating with a longitudinal slot 166 in the sleeve 164 to permit but limit the axial movement. Rocking movement is permitted by sleeve 164 turning in the anti-friction bearings 167 in which it is mounted at each end. These bearings 167 are supported by brackets 168 from the adjacent side plate 142 (FIG. 15) which support sleeve 164 parallel thereto.

Figure 14:
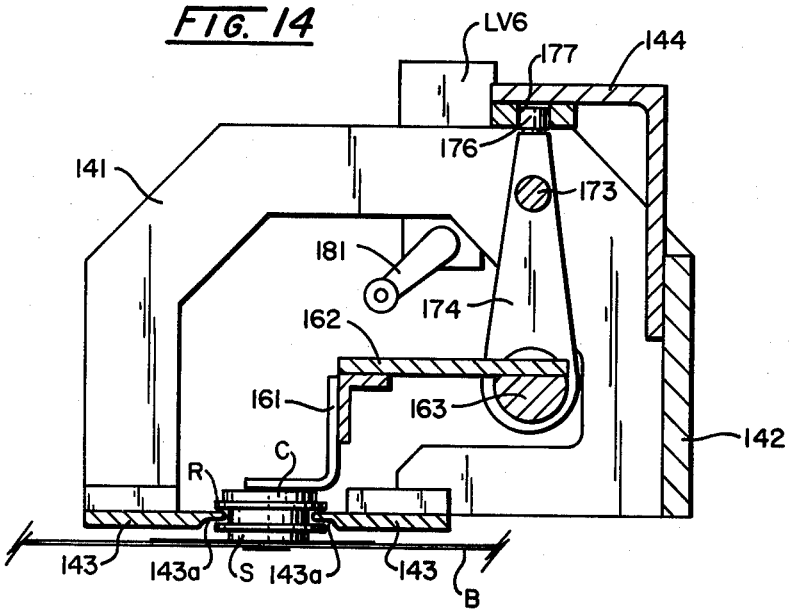
FIG. 14 is a transverse vertical sectional view taken along line 14—14 of FIG. 12.
Figure 15:
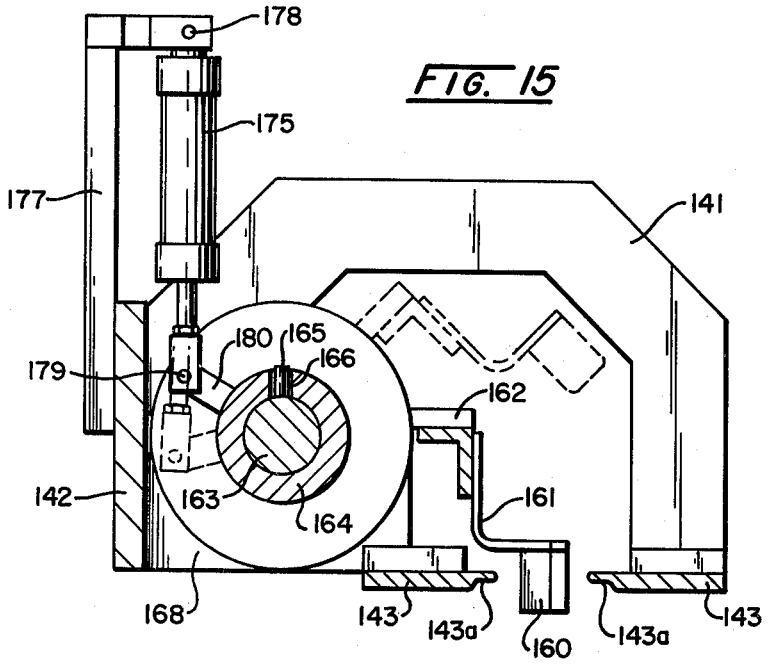
FIG. 15 is a transverse vertical sectional view taken along line 15—15 of FIG. 12.

The rod 163 is reciprocated longitudinally by means of a cylinder and piston unit 170 located above and parallel to sleeve 164, the cylinder of which is pivoted at 171 (FIG. 13) to one of the end yokes 141. The projecting piston rod 172 through connector 173, at the other end of piston and cylinder unit 170 is connected to an upstanding arm 174 rotatably secured to the rod 163 through bearing 175. The upper end of the arm 174 has a roller 176 which operates in guide track 177 during the reciprocating movement of the rod 172 with arm 174. Guide track 177 is carried by a support 144 from the plate 142. (FIG. 14).

Rocking of the rod 163 can occur through the bearing 175 of arm 174. This rocking is accomplished by means of the vertically-disposed cylinder and piston unit 175 which is supported by an inverted L-shaped bracket 177 (FIG. 15) upstanding from the plate 142. The cylinder unit 175 is pivoted at 178, at its upper end, to the horizontal arm of the bracket and the depending piston rod thereof is pivoted at 179 to the outer end of a rocket arm 180 extending radially from sleeve 164 and being rigidly connected thereto. The sleeve 164 carries rod 163 through pin 165 in slot 166 and therefore the carriage 162 can be rotated, lifting brackets 161 and fingers 160 up to clear spouts S. The carriage 162 will be moved longitudinally by control of cylinder and piston unit 170 and will be rocked by control of cylinder and piston unit 175. This will advance or return all the fingers 160 simultaneously along guide channel 144 and the feeder 140 will be such that the fingers 160 will move inwardly and advance one bag B, rock upwardly (FIG. 15) to permit the return movement, which will then occur and then rock downwardly, returning to their original dependent positions. This will successively push the spouts S of the separate bags B along through the channel 144 and space the bags equally therein (FIGS. 1 and 9) in shingled or partially-overlapping relationship.

A valve LV6 (FIGS. 1, 9 and 14) will be supported by the outermost yoke 141 and will have a depending actuating lever 181 which will be engaged by carriage 162 when it rocks upwardly. Another switch LV4 (FIG. 13) is supported by member 144 and has an actuating arm 182 that is engaged by connector 173 on rod 171.

Figure 11:
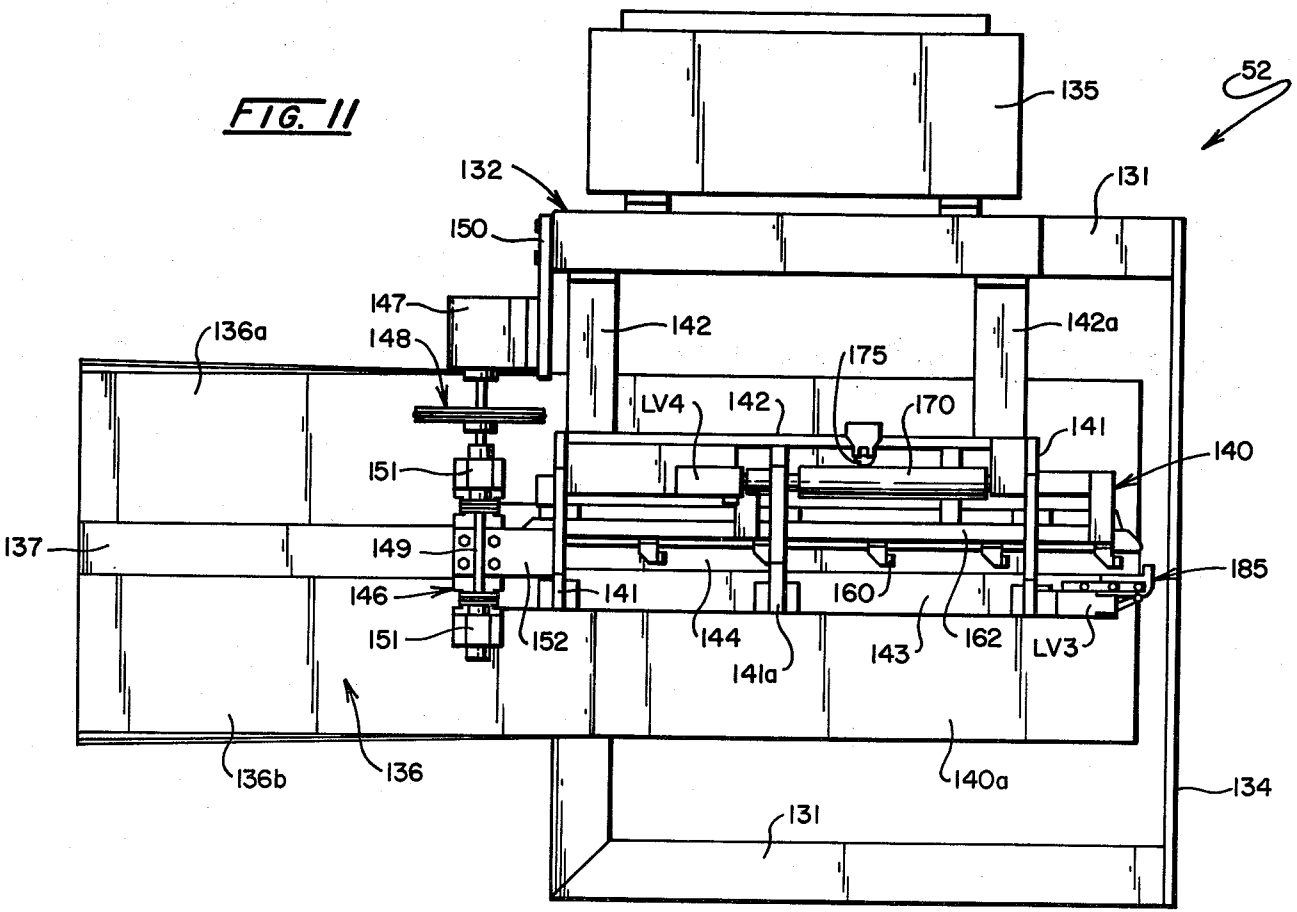
FIG. 11 is a plan view of the feeder unit.
Figure 16:
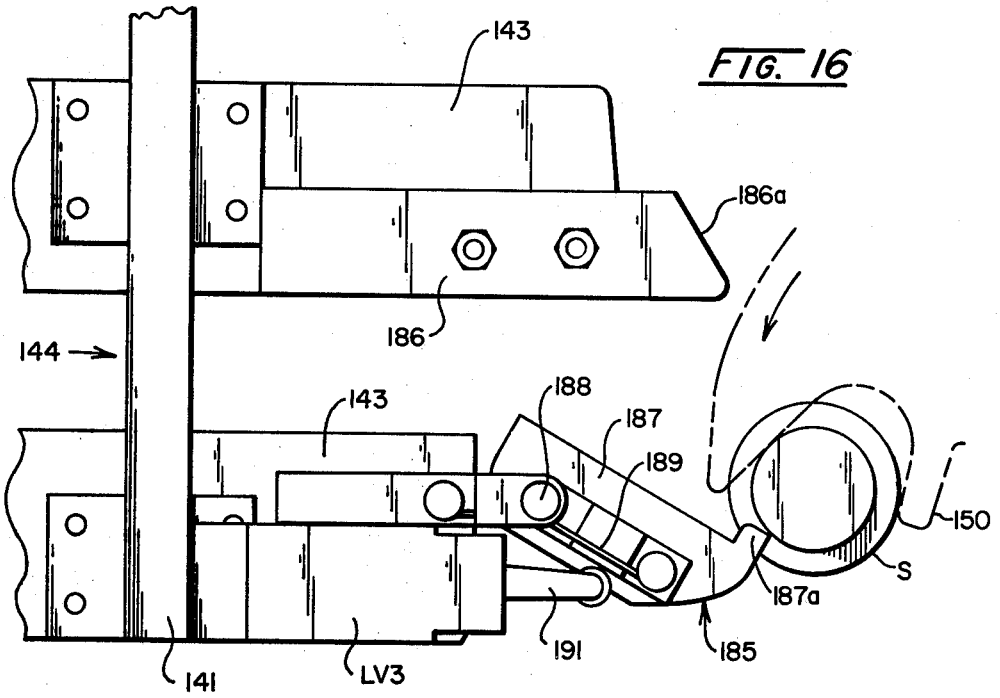
FIG. 16 is an enlarged plan view of the outer end of the spout guide channel and cooperating escapement device.
Figure 17:
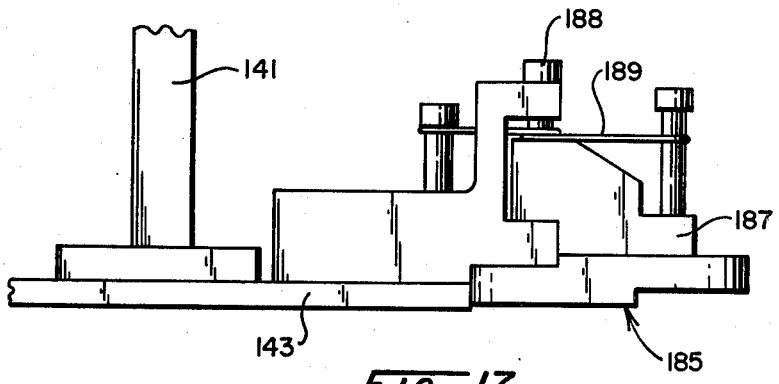
FIG. 17 is an edge view of the structure of FIG. 16.

It will be noted in FIGS. 1, 11, and 12, that the guide channel 144 extends beyond the end yoke 141. At the extreme outer end of this channel, an escapement device 185 is provided to prevent displacement of the leading spout S from the guide channel unit it is engaged by the passing clamp 150 on the filler 40. At this extreme end, the one strip 143 is provided on its end with a spout-guiding edge blade 186 which has a bevelled outer end 186*a* (FIG. 16). The other strip 143 terminates inwardly of the end of the other strip 143 and has an escapement trigger 187 mounted thereon. This trigger 187 is pivoted to the end of strip 143, at pivot 188, and is normally held in its inner position (FIG. 17) by a spring arrangement 189. A switch LV3 has its actuating plunger 191 engaging the escapement 187 to be actuated thereby upon outward swinging of the escapement trigger.

The spout S will move to the outer end of the channel 144 and be stopped by the inwardly projecting stop finger 187*a* on the escapement 187, which will be in its innermost position as shown in FIG. 12. When clamp plate 150 of filler 40 moves beneath blade 186 (FIG. 12) it will engage the spout S, forcing it against the escapement trigger 187, causing it to pivot outwardly, thereby releasing that spout. However, the escapement trigger 187 will immediately snap back into its original guide channel closing position.

A valve LV5 on the turret 40 is shown (FIG. 1) as part of the control system for the feeder unit 52. This valve is actuated successively by a cam 190 depending from each of the tables of the filler. This will start the operation of the feeder in timed relationship to rotation of the filler 40 so as to position the leading spout S of a separated bag B at the escapement 185 for removal by the oncoming revolving clamping means 150.

Figure 7:
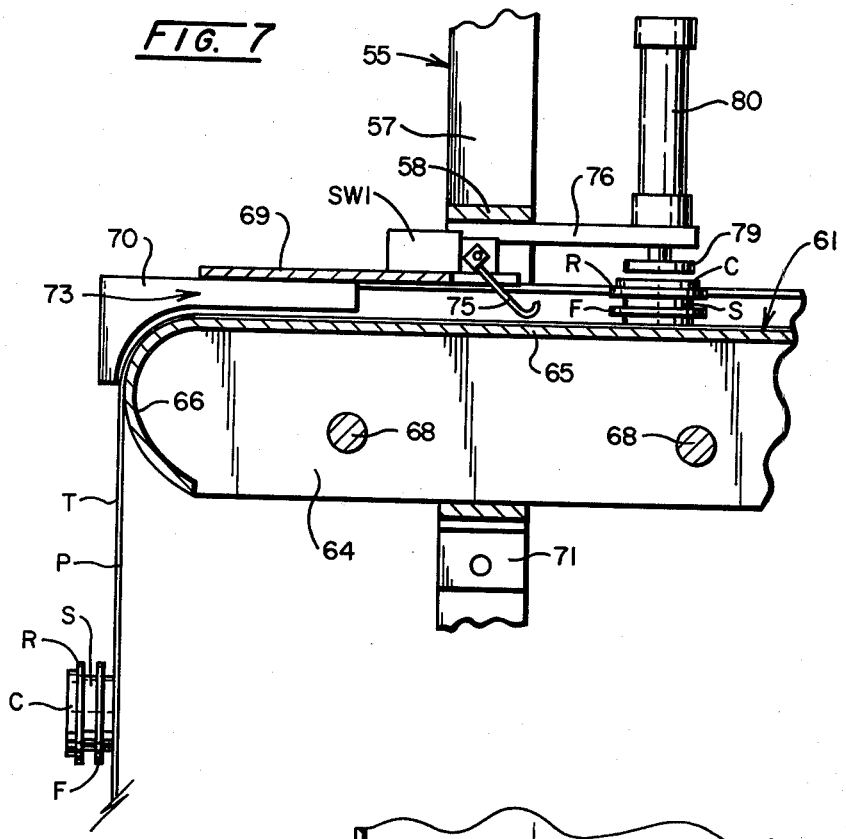
FIG. 7 is an enlarged longitudinal vertical sectional view taken along line 7—7 of FIG. 4.
Figure 8:
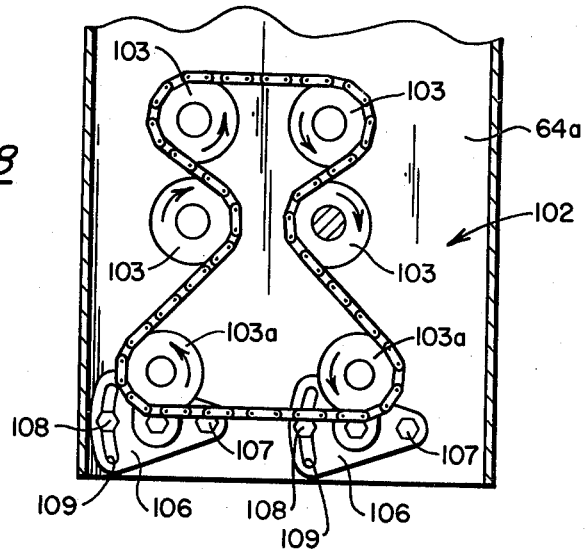
FIG. 8 is an enlarged longitudinal sectional view taken along line 8—8 of FIG. 4.

In the use of this apparatus, the strip T is pulled out of the carton through the guide 70 and onto the plate 65 of unit 51 and is threaded between the draw rolls 82 and 83 of unit 61. These rolls 82 and 83 will be driven intermittently by drive 111 and the strip will be fed into the correspondingly intermittently driven rolls 82*a* and 83*a* and on into the intermittently moved discharge conveyor 63. Before reaching the separator unit 62, the cap C on each successive spout S of the strip T will be pushed down into its final position by cylinder and piston unit 80 (FIG. 7). At the separator 62, the leading bag B will be separated by the vertical movement of blade 100, this movement being at the time that seam P is located directly thereunder in the gap G (FIG. 6). As previously indicated, engagement of the strip T by the various draw rolls 82, 83, 82*a* and 83*a* and the bands 115*a* and 115 of the discharge conveyor 63, is such that lateral distortion or displacement of the strip is precluded. As the separated bag B is moved to the end of the discharge conveyor and onto guide 136 of feeder 52, the upper frames 120 thereof are swung upwardly to release it from the upper bands 115*a* onto the stationary guide 136 (FIG. 1) of unit 52. Sometimes, the bag B will be engaged by the live guides 146, as it is moved onto the guide 136, but in either event, it will feed along guide 136 onto bed plate 140*a* with its upstanding spout S entering into guide channel 144 through mouth 145. The guide strips 143 will engage the spout between the ribs R, and the bag spouts will be engaged by the fingers 160 on the rockable and reciprocable carriage 162 to arrange the spouts in spaced relationship in the channel 144 and the bags in shingled relationship on the bed plate 140*a*. The leading bag B will have its spout S in the channel 144 stopped by the escapement 185.

The control system of the separator and feeder is mainly pneumatic instead of electronic because of moisture conditions usually encountered with apparatus of this type both in use and cleaning. It is shown in detail in FIG. 19.

Figure 19:
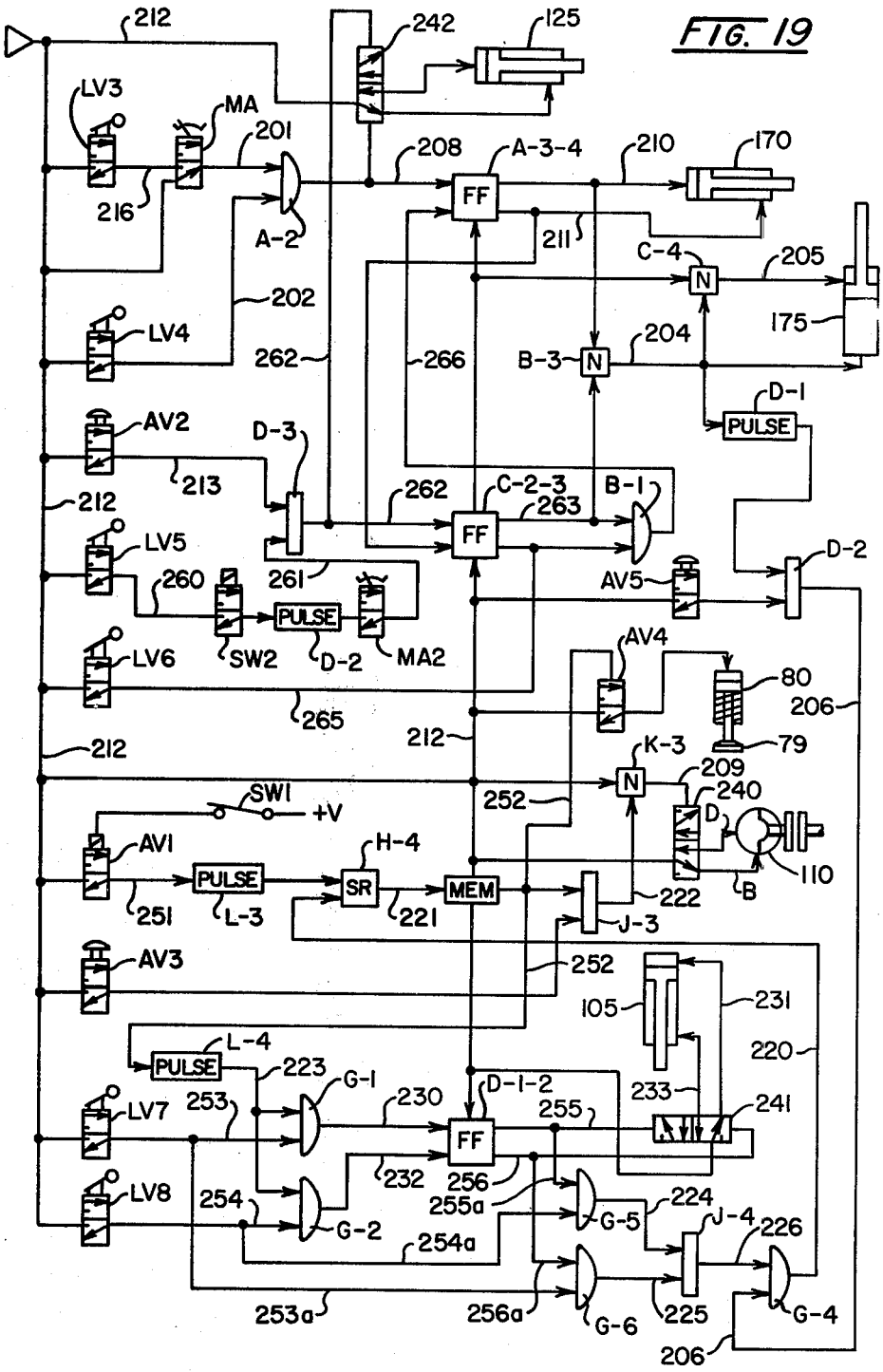
FIG. 19 is a diagram of the pneumatic control system of the machine.

This pneumatic system shown schematically in FIG. 19 is primarily what is known as pneumatic logic and is essentially based on binary logic similar to that commonly used in computer and electronics. It can be explained in terms of conventional pneumatic valve functions. In describing it, the logic terms "and, or, not, flip-flop, etc." are used with conventional pneumatic logic and electrical switching symbols based on "USA STANDARD GRAPHIC SYMBOLS FOR FLUID POWER DIAGRAMS". A system like that indicated in FIG. 19 will be provided in the boxes 56 and 56*a* carried by unit 52 and in the box 135 carried by the unit 52.

As previously indicated, the electric part of the circuit for controlling the automatic bag separator and feeder includes the drive motor 112, the switch SW1, and the drive motor 147. The rest of the circuit is pneumatic.

As indicated previously, the function of the separator unit 51 is to feed a continuous strip T of bags B into position, relative to the separator 62, stop and separate individual bags and feed separated bags B into the feeder 52 which will feed and space the bags with the leading one having its spout S for engagement with escapement 185 in position to be withdrawn by the passing clamp 150 of filler 40.

Line 212 is the air-supply line. Valve LV3 which is located at the escapement 185 is connected to line 212 through line 216 which also has a manual shut-off valve MA therein and connected to a branch of line 212. Valve LV4 located on support 144 of unit 52 is also connected to line 212 as is pushbutton valve AV2. Valve LV5 on the turntable of filler 40 is also connected to line 212 as is valve LV6 which is carried by support 141 of feeder unit 52. Valve AV1 and AV3 are also connected to line 212. Two more valves LV7 and LV8 which are on support 96 of separator 62 are connected to line 212.

The pneumatic circuit which controls separator 51 and feeder unit 52 functions as follows:

The function of the separator 51 is to position a continuous strip of bags T into position, stop and separate individual bags and feed separated bags B into the feeder unit 52. Essentially, the part of the pneumatic circuit which controls the separator 51 functions as follows:

1. Output of line 206 coming from "OR" D-2, which is made from feeder 52 or valve AV5, calls for making "AND" G-4 producing output in line 220 which resets "S/R" H-4 releasing trapped line 221. This shuts off line 252 which also drops off line 222 through "OR " J-3. Input in line 209 is produced from "N" K-3. Line 209 pilots four-way valve 240 and activates air-actuated brake and clutch 110, through line D, driving conveyor 63 and moving ahead bag strip T. Valve AV5 is a manual push button valve.

2. The moving bag strip T allows a new spout S entering unit 51 to activate AV1 through switch SW1. AV1 produces an input in line 251, sending "PULSE" signal from L-3 to set "S/R" H-4, producing an output in line 221 and through "MEM" M-4, producing an output in line 252. Line 252 does three things; (a) pilots valve AV4, sending the shoe 79, on cylinder and piston unit 80, down assuring that cap C is fully on new bag spout S, (b) goes through "OR" J-3 to shut off "N" K-3 shutting off the four-way valve 240 to air brake and clutch 110 through line B, stopping separator conveyor 63 and stopping the bag strip T; and (c) finally sends a pulse signal 223 from "PULSE" L-4 to "AND" G-1, and G-2. When separator 62 is up, making LV7, it will produce output in line 253 or down, making LV8, it will produce output in line 254. Output in line 253 will make "AND" G-1 producing output in line 230. Output in line 230 will set FLIP-FLOP D-1-2 causing output in line 255 causing four-way valve 241 to make output in line 231. This will activate piston and cylinder 105 of separator 62 to move down. Output in line 254 will make "AND" G-2, producing output in line 232. Output in line 232 will reset Flip-Flop D-1-2, causing output in line 256 to activate four-way valve 241 to make output in line 233. This will activate piston and cylinder 105 of separator 62 to move up. Operating cylinder and piston unit 105 to send separator up or down will separate bag B from the bag strip T. "AND" G-5 or G-6 are made by inputs 253*a* and 254*a* along with inputs 255*a* and 256*a* will produce either output 224 or 225 to produce output 226 at "OR" J-4. Pressure at 226 of "AND" G-4 waits for line 206, a call for new bag-starting cycle. The pushbutton stop valve AV3 may be suitably located to stop the separator unit 51 immediately for emergency shutdown.

The function of the feeder unit 52 is to push forward a bag spout into position for the rotary filler pickup. The feeder carriage 162 is operated in such a manner that pusher fingers 161 thereon move in a circular path, (a) up and back, (b) down and forward. Each pusher finger 161 moving in the above-indicated circular path, moves a bag spout S forward a certain distance, the last finger moving a bag spout into contact with escapement 185. Essentially the part of the pneumatic circuit which controls the feeder 52 functions as follows:

3. As a spout is picked up by the filler 40 at escapement 185, valve LV3 is actuated, producing output in line 216 through switch MA and continuing in line 201. If valve LV4 is made, feeder forward, line 202 is produced. Lines 201 and 202 make "AND" A-2 producing line 208. Line 208 pilots tail grip 4-way valve 242, to operate cylinder and piston unit 125 so as to cause discharge conveyor 63 to release next bag to feeder 63. Line 208 also pilots "FF" A-3-4, producing line 210. Line 210 actuates cylinder and piston unit 170 to send feed carriage back, and also goes through "N" B-3 producing line 204. Line 204 rocks carriage 162 by shutting off line 205 at "N" C-4 moving piston of rocking unit 175 upwardly, producing line 204 to "PULSE" D-1, to "OR" D-2 producing line 206 to separator 51 calling for another bag to feeder 52.

4. As turntable of filler 40 rotates, it makes valve LV5, calling for feeder 63 to push another spout S forward into engagement with escapement 185. LV5 produces line 260 going through remote feeder off switch SW2 producing "PULSE" D-2 signal through auto switch MA2 producing line 261. Line 261 to "OR" D-3 produces line 262. Line 262 pilots 4-way valve to cause cylinder and piston unit 125 to return separator discharge conveyor to gripping position. It also pilots "FF" C-2-3, producing line 263. Line 263 shuts air off line 204, through "N" B-3. This reinstates line 205, sending piston of unit 175 down, making valve LV6 producing line 265. Lines 265 and 263 make "AND" B-1, producing line 266, which resets "FF" A-3-4, producing line 211 sending feeder carriage 162 forward, pushing spouts S into next position.

5. Switching to manual, through valves MA and MA2, sends feeder fingers 160 up and back and calls for a bag B to feeder 63. Pressing manual button of valve AV2 in line 213 sends feeder 63 forward for manual feeding. Releasing manual button sends feeder carriage 162 up and back immediately.

It will be apparent from the above description that this invention provides apparatus which will receive a continuous strip of flexible bags with upstanding spouts, that carry caps, push the caps down into position, separate the strip into individual bags, and feed and space the bags so that the leading one can be withdrawn for use.

Having thus described this invention what is claimed is:

1. A separator and feeder for separating a flexible strip at successive longitudinally-spaced transverse intervals comprising a vertically-reciprocable separator means extending transversely, means for intermittently reciprocating said separator means, conveyor means for intermittently and positively advancing the strip longitudinally to said separator means and for intermittently and positively moving the separated part of the strip away from said separator means, and means for timing the reciprocating of said separator means and said conveyor means; said conveyor means including a first set of rolls comprising upper and lower transversely-extending draw rolls disposed ahead of said separator means for advancing the strip to the separator means and comprising a lower gripping roll and a pair of axially-spaced upper gripping rolls to provide a passage so that upward projections on the strip can pass between said upper rolls, said conveyor means also including a discharge conveyor disposed just beyond said separator means which includes a second set of upper and lower transversely-extending rolls and a third set of upper and lower transversely-extending rolls spaced longitudinally beyond the second set, laterally-spaced gripping bands passing continuously around the respective lower and upper rolls of the second and third sets to grip the strip therebetween, said second and third sets of rolls having axially-spaced upper rolls to provide a passage in alignment with the first-named passage, said bands on the upper rolls of the second and third sets being divided into two laterally-spaced groups carried by the upper rolls of the respective second and third sets with said passage therebetween, each laterally-spaced group being carried by a frame mounted for swinging movement around the axis of the laterally-spaced upper rolls of the second set, and means for intermittently producing said swinging movement to release the gripped severed portion of the strip in timed relationship to the intermittent movement of the conveyor means.

2. The separator and feeder according to claim 1 in which the separator includes a separating member which has both upper and lower severing edges, said separator including a support for the separating member which permits the passage of the strip above the separating member when it is in its lowermost position so that severance can occur both on the upstroke and downstroke of the separator.

3. The separator and feeder according to claim 2 in which the separator member is in the form of a blade of predetermined transverse extent having outer ends and triangular points at its upper and lower edges, the outermost points being spaced inwardly from the outer ends of the blade.

4. The separator and feeder according to claim 1 in which the outermost bands of the respective group are inwardly-spaced from the ends of the rolls so as to grip the strip laterally inwardly of its outermost edges.

5. The separator and feeder according to claim 1 in which the draw rolls are formed to grip the strip at points laterally inwardly of the edges of the strip.

6. The separator and feeder according to claim 5 in which the draw rolls are formed with axially-spaced grooves so as to grip the strip along laterally-spaced bands.

7. The separator and feeder according to claim 1 comprising reciprocable means above the conveyor means ahead of the separator means carrying a shoe adapted to engage successive projections on said strip, and means for operating said reciprocable means in timed relationship to the conveyor means.

8. The separator and feeder according to claim 1 or 2 including means for receiving and spacing the separated portions of the strip as they are successively discharged by said conveyor.

9. The separator and feeder according to claim 8 in which the strip separated into the separated portions is a strip of bags having transverse separation joints at said intervals and upstanding spouts at longitudinally spaced intervals to provide individual spout-carrying bags when separated at said joints, said means for receiving and spacing the spouts of the individual bags comprising a bag-feeding carriage mounted for longitudinal reciprocal movement and transverse rocking movement and carrying a plurality of spout-engaging fingers, and a spout-receiving guide channel for receiving the spouts of the individual bags from said separator along which the carriage is moved to space the spouts therein and having inlet and outlet ends, and means for actuating said carriage intermittently in timed relationship to the separator.

10. The separator and feeder according to claim 9 including a bed plate below the spout-receiving guide channel along which the separated bags are moved by the carriage, guide means at the inlet end of the guide channel for guiding the bags received from the separator onto the bed plate and the spouts into the guide channel.

11. The separator and feeder according to claim 10 wherein the guide means comprises a guide plate and driven guide rolls spaced above the guide plate for engaging bags as they are discharged by the separator.

12. The separator and feeder according to claim 11 including an escapement stop device at the outlet end of said spout-receiving guide channel.

13. The separator and feeder according to claim 12 in which the spout-engaging guide channel is formed by opposed guide strips which engage the spout between vertically-spaced flanges thereon, said escapement stop device having an aligning strip portion pivoted to the end of one of said strips and being a continuation thereof but having a stop extending into the channel, and resilient means normally keeping the strip portion in stopping position but yieldable to permit displacement of the leading spout in the guide channel.

14. The separator and feeder according to claim 11 in which the guide plate has its side edges down-turned to guide the bag onto the bed plate, and the inlet end of the spout channel has a flared throat to facilitate entrance of each spout.

15. The separator and feeder according to claim 9 in which said carriage is a longitudinally-extending support member having the spout-engaging fingers thereon disposed along said channel, means for mounting the support member for the longitudinal and rocking movement and including a longitudinally-extending sleeve disposed in parallel relationship to said channel and carried by bearings which permit rocking thereof transversely relative to the channel, a rod mounted in said sleeve for limited axial but non-rotative movement therein, and means for rocking the rod and therefore the sleeve.

16. The separator and feeder according to claim 15 including stop means for limiting the reciprocation of the rod in the sleeve and comprising a radial pin in the rod extending into a longitudinal slot in the sleeve.

17. A separator and feeder for separating a strip of flexible bags, having upstanding spouts, at successive longitudinally-spaced transverse joints, comprising a vertically-reciprocable separator member, means for reciprocating the separator member, in-feed conveyor means ahead of the separator member for feeding the strip thereto and discharge conveyor means beyond the separator member for discharging the separated bags, means for driving the conveyor means intermittently, a feeder including a bed plate onto which the separated bags are moved, a longitudinally-extending, spout-receiving guide channel above the bed plate having inlet and outlet ends, said feeder also including a carriage which is mounted for longitudinal reciprocating and transverse rocking movements relative to said guide channel, fingers carried by said carriage at longitudinally-spaced intervals so that in a lower rocked position of the carriage they will extend into the channel and in an upper rocked position they will be withdrawn from the channel, means for intermittently moving said carriage longitudinally forwardly to cause it to move in a feeding stroke forwardly when the fingers are down to push the spouts along the guide channel and rearwardly in a retracting stroke when the fingers are up to miss the spouts, and means for rocking the carriage between a position where the fingers are down in the channel and a position where the fingers are up out of the channel; a pivoted escapement being provided at the outlet end of the spout channel for stopping the leading spout therein, and yieldable means for normally holding the escapement in a position where the leading spout in the channel will be engaged and stopped.

18. The separator and feeder according to claim 17 in which the bags of the strip have upstanding spouts with caps applied thereto by axial inward movement, a pressing unit mounted above the in-feed conveyor having a shoe for successively engaging the caps and pressing them downwardly, and means for intermittently actuating said unit.

19. The separator and feeder according to claim 17 in which the separator member includes a blade having outer ends supported by guide members for the vertical reciprocation, said blade having upper and lowering severing edges each of which comprises severing points spaced inwardly from the corresponding outer edges.

20. The separator and feeder according to claim 17 in which the infeed conveyor for the feeder comprises a horizontal guide and support plate for receiving the bag strip, draw rolls located just ahead of the separator member extending transversely of the plate for gripping the strip, said rolls being formed to grip the strip at points laterally inwardly of the edges thereof, said rolls also being formed with axially-alternating grooves and gripping surfaces.

21. The separator and feeder according to claim 20 in which the draw rolls comprise a lower gripping roll and a pair of axially-spaced upper gripping rolls to provide a passage so that the upstanding spouts on the bag strip can pass between the rolls.

22. A separator and feeder for separating a strip of flexible bags, having upstanding spouts, at successive longitudinally-spaced transverse joints, comprising a vertically-reciprocable separator member, means for reciprocating the separator member, in-feed conveyor means ahead of the separator member for feeding the strip thereto and discharge conveyor means beyond the separator member for discharging the separated bags, means for driving the conveyor means intermittently, a feeder including a bed plate onto which the separated bags are moved, a longitudinally-extending, spout-receiving guide channel above the bed plate having inlet and outlet ends, said feeder also including a carriage which is mounted for longitudinal reciprocating and transverse rocking movements relative to said guide channel, fingers carried by said carriage at longitudinally-spaced intervals so that in a lower rocked position of the carriage they will extend into the channel and in an upper rocked position they will be withdrawn from the channel, means for intermittently moving said carriage longitudinally forwardly to cause it to move in a feeding stroke forwardly when the fingers are down to push the spouts along the guide channel and rearwardly in a retracting stroke when the fingers are up to miss the spouts, and means for rocking the carriage between a position where the fingers are down in the channel and a position where the fingers are up out of the channel; said infeed conveyor for the feeder comprising a horizontal guide and support plate for receiving the bag strip, draw rolls located just ahead of the separator member extending transversely of the plate for gripping the strip, said rolls being formed to grip the strip at points laterally inwardly of the edges thereof, said rolls also being formed with axially-alternating grooves and gripping surfaces, said rolls comprising a lower gripping roll and a pair of axially-spaced upper gripping rolls to provide a passage so that the upstanding spouts on the bag strip can pass between the rolls, said discharge conveyor for discharging the separated bags from the separator comprising a second set of upper and lower transversely-extending gripping rolls just beyond the separator member and spaced ahead of the draw rolls to provide a gap therebetween through which the separator member can reciprocate, said second set of rolls being formed with axially-spaced grooves and gripping surfaces, said rolls comprising a lower gripping roll and a pair of axially-spaced upper gripping rolls to provide a passage so that the upstanding spouts on the strip can pass between said upper rolls; a third set of transverse rolls including upper and lower rolls spaced horizontally beyond the second set in parallel relationship thereto to receive gripping bands which are passed continuously around said second and third set in said grooves and are disposed in laterally-spaced relationship, means for intermittently driving all of said rolls, the outermost bands being inwardly spaced from the ends of the rolls, said third set of rolls including a lower transverse roll and a pair of axially alligned upper rolls spaced apart to provide a central spout passage, said bands on the upper rolls being divided into two laterally-spaced groups carried by the upper rolls of the respective second and third sets with a central spout passage therebetween, each group being carried by a frame mounted for swinging movement around the axis of the laterally-spaced upper rolls of the second set, and means for intermittently producing said swinging movement to release the severed bag.

23. The separator and feeder according to claim 22 including guide means at the inlet end of the guide channel for guiding the separated bags onto the bed plate and the spouts into the guide channel, and constantly-driven guide rolls spaced above the guide plate for engaging bags as they are discharged by the discharge conveyor.

24. The separator and feeder according to claim 22 in which the spout-engaging guide channel is formed by opposed guide strips extending in parallel relationship above and longitudinally of the bed plate adapted to engage the spouts between axially-spaced flanges, said channel having an outlet and a yieldable escapement at the outlet for stopping the leading spout.

25. The separator and feeder according to claim 24 in which said carriage is a longitudinally-extending support member having the spout-engaging fingers thereon disposed along said channel, means for mounting the support member for the longitudinal and rocking movement and including a longitudinally-extending sleeve disposed in parallel relationship to said channel and carried by bearings which permit rocking thereof transversely relative to the channel, a rod mounted in said sleeve for limited axial but non-rotative movement therein by means including a radial pin on the rod and an axial slot in the sleeve, means for mounting said rod axially intermittently in the sleeve, and means for rocking the rod and, therefore, the sleeve, said means for moving the rod axially, being connected to an arm upstanding from the rod and operating in a guide track, when the rod is moving axially said arm being rotatably connected to the rod.

26. The separator and feeder according to claim 22 in which said separator is mounted in a vertical support for its reciprocation, a pneumatic cylinder and piston unit mounted on said support and connected to said member to produce its reciprocation, said conveyor driving means for the in-feed and discharge conveyor means for the separator including a pneumatically-actuated clutch and brake unit, said means for producing the intermittent swinging movement of the frame comprising a cylinder and piston unit connected thereto, said means for intermittently moving the feeder carriage longitudinally comprising a pneumatic cylinder and piston unit connected to said rod, and said means for intermittently rocking the carriage comprising a pneumatic cylinder and piston unit connected to said rod.

27. The separator and feeder according to claim 26 including a pneumatic control system in which all of said cylinder and piston units and clutch unit are connected, and control valves connected in said system for controlling all of said units.

28. The separator and feeder according to claim 27 in which the pneumatic system includes an additional cylinder and piston unit mounted above the in-put conveyor means, with a shoe vertically reciprocable to push caps on successive spouts.

* * * * *

UNITED STATES PATENT OFFICE

CERTIFICATE OF CORRECTION

Patent No. 4,297,929 Dated November 3, 1981

Inventor(s) Warren J. Schieser and Stanley E. Vickers

It is certified that error appears in the above-identified patent and that said Letters Patent are hereby corrected as shown below:

Column 16, line 36, change "mounting" to --- moving ---.

Signed and Sealed this

*Twelfth* Day of *January 1982*

[SEAL]

*Attest:*

GERALD J. MOSSINGHOFF

*Attesting Officer* *Commissioner of Patents and Trademarks*